US006138666A

United States Patent [19]

Hubbard

[11] Patent Number: 6,138,666

[45] Date of Patent: Oct. 31, 2000

[54] DIRECT FIRED OUTDOOR HEATER AND HEATING METHOD

[75] Inventor: Michael J. Hubbard, Dallas, Tex.

[73] Assignee: Teledyne Technologies Incorporated, Los Angeles, Calif.

[21] Appl. No.: 09/189,213

[22] Filed: Nov. 10, 1998

[51] Int. Cl.[7] ..... F24H 1/00; F24H 9/02

[52] U.S. Cl. ..... 126/307 R; 126/350.1; 126/163 R; 122/367.3; 454/8; 454/41

[58] Field of Search ..... 126/350 R, 307 A, 126/85 R, 85 B, 307 R, 163 A, 163 R, 92 R, 350.1; 110/162; 454/41, 8, 16, 15, 184, 431, 154, 11, 208

[56] References Cited

U.S. PATENT DOCUMENTS

| | | | |
|---|---|---|---|
| 3,364,838 | 1/1968 | Bradley | 454/184 |
| 3,512,910 | 5/1970 | Hein | 421/154 |
| 3,614,281 | 10/1971 | Ramey et al. | 431/154 |
| 3,623,458 | 11/1971 | Block et al. | 126/85 R |
| 3,800,748 | 4/1974 | Schindler et al. | 126/85 B |
| 3,921,592 | 11/1975 | Calvin et al. | 126/85 B |
| 4,091,768 | 5/1978 | Widdershoven | 122/367.3 |
| 4,580,548 | 4/1986 | Ono . | |
| 4,651,711 | 3/1987 | Velie | 126/116 A |
| 4,679,545 | 7/1987 | Cavestany | 126/350 R |
| 4,893,609 | 1/1990 | Giordani et al. . | |
| 4,976,253 | 12/1990 | Beal et al. | 126/92 R |

FOREIGN PATENT DOCUMENTS

| | | | |
|---|---|---|---|
| 1265957 | 3/1972 | United Kingdom | 126/85 B |

*Primary Examiner*—Ira S. Lazarus
*Assistant Examiner*—Sara Clarke
*Attorney, Agent, or Firm*—Patrick J. Viccaro

[57] ABSTRACT

A heater includes a housing having an angled top, a fan having a discharge disposed parallel to the angled top of the housing, and a baffle for laminarizing airflow through the heater. The heater may also create airflow through a cover, across a housing, a heat sensitive component, and/or a raceway, and into a housing inlet. The heater may include a manifold having at least one coupling member that slidingly engages and disengages a burner. Methods for propelling combustion air through a heater, laminarizing combustion airflow in a heater, improving the efficiency of a heater, and converting a heater to make it compatible with a different fuel are also disclosed.

35 Claims, 13 Drawing Sheets

DIRECT FIRED OUTDOOR HEATER AND HEATING METHOD

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a heating appliance and, more particularly, to a direct fired heating appliance suitable for outdoor use.

2. Description of the Invention Background

A variety of direct fired heating appliances have been developed and are commonly used to heat fluids, such as water or glycol, or gasses, such as air. The term "direct fired" typically indicates that fuel is burned directly within the heater to create heat which is used to warm a desired medium. In one application, a direct fired heater is utilized to warm water in a swimming pool or spa. A typical heater employed to heat pool or spa water includes a burner assembly and a heat exchanger assembly enclosed in a housing.

A typical burner assembly includes a burner subassembly, a fuel distribution assembly and an igniter. Fuel is supplied to the fuel distribution assembly through a fuel supply line. The fuel is regulated and distributed to the burner subassembly through the fuel distribution assembly. The fuel distribution assembly is typically comprised of a fuel valve and regulator, which are often combined into a single unit, and a fuel manifold.

A conventional fuel valve and regulator unit typically has an inlet port for connection to a fuel supply line, an outlet port for connection to the fuel manifold, a twoposition flow control member with an actuator that may be manipulated to position the flow control member to either permit or prevent the flow of fuel through the valve and a regulating flow control member that is modulated to maintain a constant fuel flow rate. A conventional fuel manifold includes an inlet port that is connected to the fuel valve and regulator and a plurality of coupling members having orifices and barbs for connection to a burner.

A conventional burner subassembly includes a plurality of burner elements and a rack supporting the elements. Each burner element is connected to a fuel manifold coupling member and held in place by the barb of the coupling member. Various fuels, such as propane and natural gas, may be burned in a typical heater and fuel manifolds typically must be configured differently for each fuel. For example, the orifice size may vary depending on the thermal properties of the fuel and the pressure at which the fuel is delivered so that the designed amount of heat is produced in the heater.

While conventional fuel manifolds can effectively distribute fuel to a burner, a shortcoming of such manifolds is that they are not easily replaced. The barbed coupling members of a conventional fuel manifold engage the burner such that disengagement is difficult and may be damaging to the fuel manifold or burner. Thus, when a manifold becomes damaged or a new fuel is desired to be utilized, conventional burner and manifold assemblies are typically replaced in their entirety. Therefore, there is a need for a replaceable fuel manifold.

A conventional burner consists of a series of burner elements arranged in a frame such that combustion air may flow around the burner elements. Each burner element typically has a fuel supply port to which is connected one of the barbed coupling members of the fuel manifold and through which the fuel enters the burner element. A typical burner element, furthermore, includes a series of openings along its upper surface through which the fuel flows and at which point the fuel is burned.

An igniter is situated above the burner to ignite the fuel flowing through the openings in the elements of the burner. A conventional igniter may be a standing pilot or an electronically controlled ignition system.

A conventional heat exchanger includes a tube subassembly, a primary manifold and a secondary manifold. The heat exchanger is typically located above the burner such that heated air rising from the burner becomes incident on the exterior surfaces of the heat exchanger. The heat exchanger may also contain baffles around the tube subassembly that direct the heated air against the tube subassembly to maximize heat transferred to the pool water. A conventional tube subassembly is comprised of a series of heat conducting tubes disposed in parallel with each end of each tube connected to a manifold. The purpose of the tube subassembly is to transfer heat from a high temperature medium to a low temperature medium while preventing the high and low temperature mediums from contacting each other. To accomplish that heat transfer in such a tube assembly, either the high or low temperature medium is forced through the heat conductive tubes while the other medium is forced to flow past the external surfaces of the tubes in contact therewith. When the high temperature medium contacts the lower temperature tubes, heat is transferred from the high temperature medium to the tubes. Likewise, heat is transferred from the tubes to the lower temperature medium as the low temperature medium contacts the tubes. Thus, heat from the high temperature medium is transferred through the heat conductive tubes to the lower temperature medium.

A typical housing for a direct fired heating appliance is a four sided enclosure with a combustion air inlet near the bottom of one side and a combustion air outlet at its top. The burner assembly may be supported by the housing above the combustion air inlet, and a heat exchanger assembly may be supported by the housing above the burner assembly. The space generally between the burner assembly and heat exchanger assembly is referred to as the "combustion chamber."

In operation, a pressurized fuel is present in the fuel supply line and at the fuel valve. When heater operation is desired, the fuel valve is opened, permitting the fuel to flow into the manifold. Thereafter, the pressurized fuel flows through the orifices of the manifold into the burner elements and out of the burner elements through the burner openings where the fuel is ignited and consumed, thereby heating the air in the combustion chamber.

Combustion air is concurrently circulated through the heater, typically flowing in through the bottom of the heater, up past the burner, through the heat exchanger and exiting through the top of the heater. Purposes of circulating combustion air through the heater include providing oxygen to assist in combustion, preventing the build-up of products of combustion in the heater, and carrying heat created by the burning fuel to the heat exchanger.

A continuous supply of oxygen-rich combustion air must be provided to the combustion chamber in order to promote thorough, efficient burning of all fuel. Adequate air circulation through the heater is also necessary to prevent the heater from being damaged by overheating. Adequate air circulation also prevents the build-up in the appliance of oxides of nitrogen, carbon monoxide, and other products of combustion that may damage the appliance or may be hazardous to humans.

The combustion air in the combustion chamber is also heated by the burning fuel. The heated air rises through the combustion chamber, contacting the heat exchanger and transferring heat from the air, through the heat exchanger to the pool or spa water. After passing across the heat exchanger, the heated air, or "flue gas," is vented out of the heater.

A certain pool heater utilizes a natural drafting system, which relies on the buoyancy of heated flue gasses to circulate air through the heater. In such a system, air in the combustion chamber is heated, thereby becoming more buoyant than the ambient air. The buoyant flue gasses rise through the heat exchanger and out of the housing, evacuating the combustion chamber. Fresh combustion air is drawn into the combustion chamber through a lower opening in the housing to replace the escaping flue gasses. In that way air is circulated through the pool heater, entering through a lower portion of the housing and leaving through an upper portion of the housing.

Natural draft systems must, however, balance the opposing goals of transferring heat from the flue gasses to the pool water and permitting flue gasses to be vented at a temperature high enough to create adequate air circulation. The result is that natural draft systems waste energy because the flue products must be maintained at a high temperature to insure that air circulation is adequate to prevent heat damage to the heater and to prevent the buildup of hazardous products of combustion.

In outdoor applications, the use of natural drafting appliances is also problematic because wind may overcome the natural draft created by the heated flue gasses, thereby preventing proper air circulation through the appliance. In certain natural draft appliances, baffles are used to isolate the flue gasses from wind and to create alternative venting paths. The alternative venting paths limit the effect of wind by providing paths from which the gasses may be exhausted when ambient pressure exceeds flue gas pressure at certain paths and prevents the flue gasses from venting at those paths. The baffles, however, restrict airflow both by the friction of the air against the many baffle sections and the redirection of the air by the baffles, thereby reducing, rather than improving, circulation through the appliance. Appliances so constructed often experience poor combustion, soot build up and a tendency for flames to roll out of the appliance.

Another heating appliance utilizes a supply fan disposed at the combustion air intake to circulate combustion air through the heater. The supply fan provides pressurized air to the combustion chamber. The pressurized air propels the flue gasses out of the appliance with a force that will typically overcome the effects of wind, insuring that proper draft is maintained through the appliance. The pressurize combustion chamber, however, creates a potential for flames to escape from the appliance should the combustion chamber become breached. Another result of the pressurized combustion chamber is that a direct, unrestricted pathway must be provided at the exit of the heater to prevent overpressurization of the combustion chamber. A heater utilizing a supply fan is subject to the effects of rain because of the direct exhaust pathway and so is not well suited to outdoor use.

Certain other heating appliances utilize a venting fan disposed at the flue gas vent to circulate combustion air through the heater. The venting fan is intended to draw flue gasses out of the appliance and to create negative pressure in the appliance sufficient to draw combustion air into the combustion chamber from the combustion air inlet. The venting fan also expels the flue gasses from the appliance under pressure that will typically overcome the effects of wind. Venting fans are typically even more costly than combustion air fans because they must be designed to operate under high temperature conditions. Venting fans may also create turbulence in the combustion chamber which can adversely affect combustion. When used in outdoor applications, the venting fan should be protected from rain and other precipitation, necessitating the use of a cover. Certain previous venting fan covers, however, have prevented free passage of flue gasses out of the appliance, resulting in the collection of corrosive condensation from the flue gas on components of the appliance. A need, therefore, exists for an efficient, long lasting heating appliance that provides proper combustion air circulation.

In conventional heaters having both natural and fan-induced draft systems, high temperatures are typically experienced in and around the heater due to heat transfer from the combustion chamber through the housing. Combustion and electrical components that may be utilized to control operation of the heater are typically disposed on or near the housing. Exposure of these components to the high temperature of the heater is damaging to and reduces the operational life of the components. Furthermore, an appliance that loses excessive heat through its housing may be inefficient. Additional fuel must be expended and a larger heating appliance may be required to induce the same heat gain in the pool water when heat is lost to the atmosphere rather than transferred into the pool water. An excessively hot housing also poses a risk to people and property in the vicinity of the appliance. Therefore, a need also exists for a heater that prevents exposure of combustion and electrical components to high temperatures and recovers heat from the housing.

Thus, there is a need for a heater that may be more easily serviced, offers improved combustion emissions, has cooler external surface temperatures and has a longer service life.

BRIEF DESCRIPTION OF THE DRAWINGS

In the accompanying figures, there are shown present preferred embodiments of the invention wherein like reference numerals are employed to designate like parts and wherein.

SUMMARY OF THE INVENTION

Figure 1:
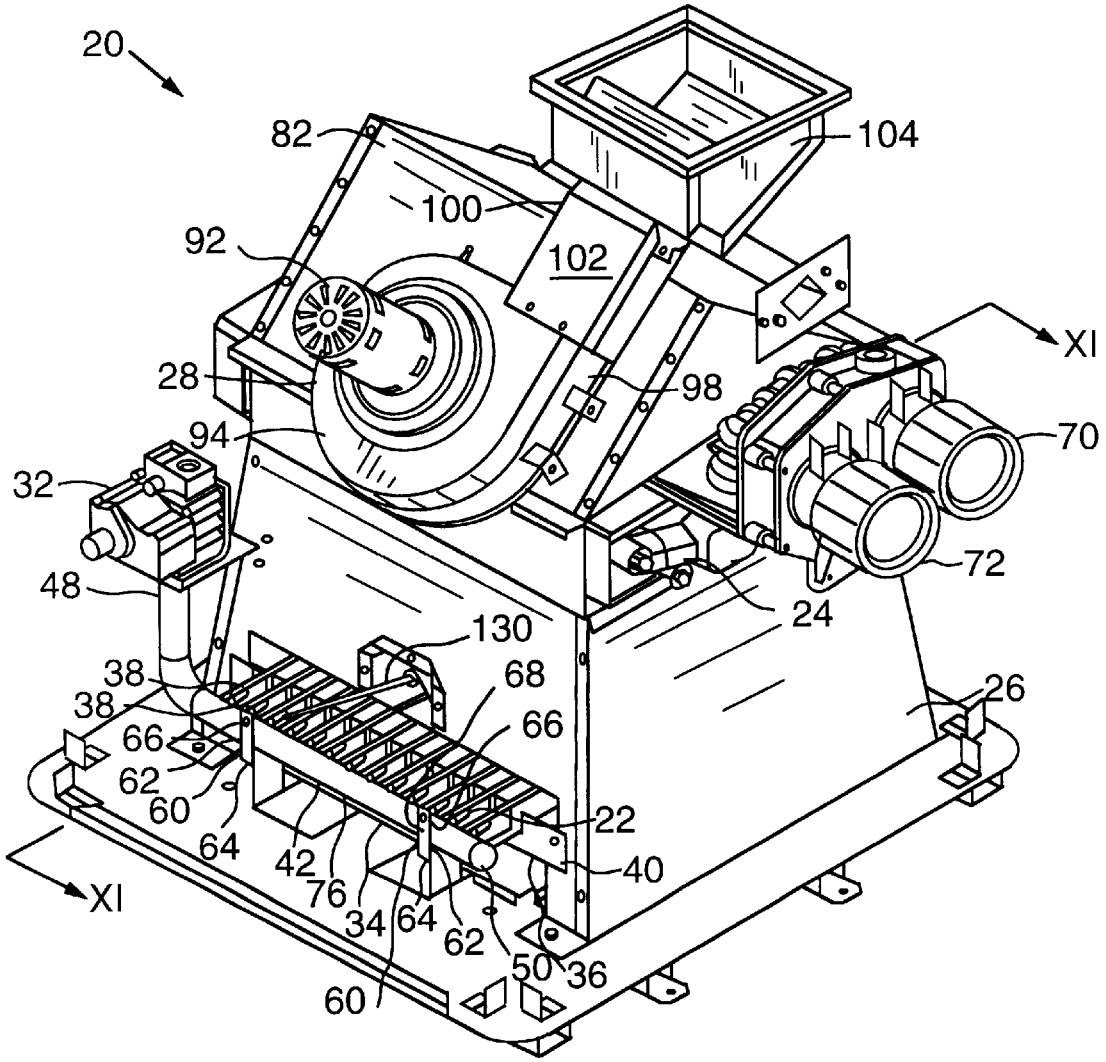
FIG. 1 is a perspective view of a heating appliance of the present invention.

The present invention is directed to a heater. The heater includes a housing having an angled top and the angled top includes a flue. The heater also includes a fan having an intake opening and a discharge opening, wherein the intake opening is in communication with the flue and the fan discharge opening is disposed parallel to the angled top of the housing. The fan may include a drain in its upper portion, a drain in its lower portion, and/or a duct and may have a restriction in its intake. The heater may also include a cover, a burner, and/or a heat exchanger.

The present invention is also directed to a heater comprising a housing, wherein the housing has an inlet and an outlet. The heater also includes a burner supported by the housing and a heat exchanger supported by the housing intermediate the burner and the outlet of the housing. In addition, the heater includes a fan in communication with the housing and a baffle disposed in the housing. The baffle may be located intermediate the inlet and the burner and/or intermediate the heat exchanger and the outlet. The baffle may furthermore be a perforated plate.

The present invention is additionally directed to a heater that includes a housing, the housing having an inlet, a cover disposed over the housing, the housing having at least one opening and an interior chamber and a fan in communication with the housing. The fan creates an airflow through the at least one opening into the interior chamber, across the housing, a heat sensitive component, and/or a raceway, and into the housing inlet.

The present invention is furthermore directed to a manifold for use with a burner that includes a body, the body having an interior cavity, and at least one coupling member disposed on the body, each coupling member having an insertion portion that slidingly engages and disengages the burner. The manifold may be held in cooperation with the burner by an attachment device.

The present invention is also directed to a method of propelling combustion air through a heater including a fan, the method comprising providing the heater with a sloping upper surface and an outlet in the upper surface, drawing the combustion air through the opening of the upper surface, and directing the combustion air parallel to the upper surface of the heater. The method may also include draining liquid that enters the heater away from the fan.

The present invention is additionally directed to a method of laminarizing combustion airflow in a heater that includes directing the combustion air through at least one baffle.

The present invention is also directed to methods of improving the efficiency of a heater comprising drawing combustion air across a housing, a heat sensitive component, and/or a raceway to transfer heat from the housing, heat sensitive component, and/or raceway to the combustion air and directing the combustion air past a burner of the heater.

The present invention is furthermore directed to a method of converting a heater to make it compatible with a different fuel, comprising disengaging a first fuel manifold from a burner of the heater and engaging a second fuel manifold to the burner.

The reader will appreciate the foregoing details and advantages of the present invention, as well as others, upon consideration of the following detailed description of embodiments of the invention. The reader also may comprehend such additional details and advantages of the present invention upon using the invention.

DETAILED DESCRIPTION OF EMBODIMENTS OF THE INVENTION

It is to be understood that the figures and descriptions of the present invention included herein illustrate and describe elements that are of particular relevance to the present invention, while eliminating, for purposes of clarity, other elements found in a typical direct fired heating appliance of a known construction. Because the construction and implementation of such other elements are well known in the art, and because a discussion of them would not facilitate a better understanding of the present invention, such a discussion is not provided herein. It is also to be understood that the embodiments of the present invention that are described herein are illustrative only and are not exhaustive of the manners of embodying the present invention. For example, it will be recognized by those skilled in the art that the present invention may be readily adapted to function in conjunction with a variety of appliances that require air circulation or fuel distribution.

Figure 9:
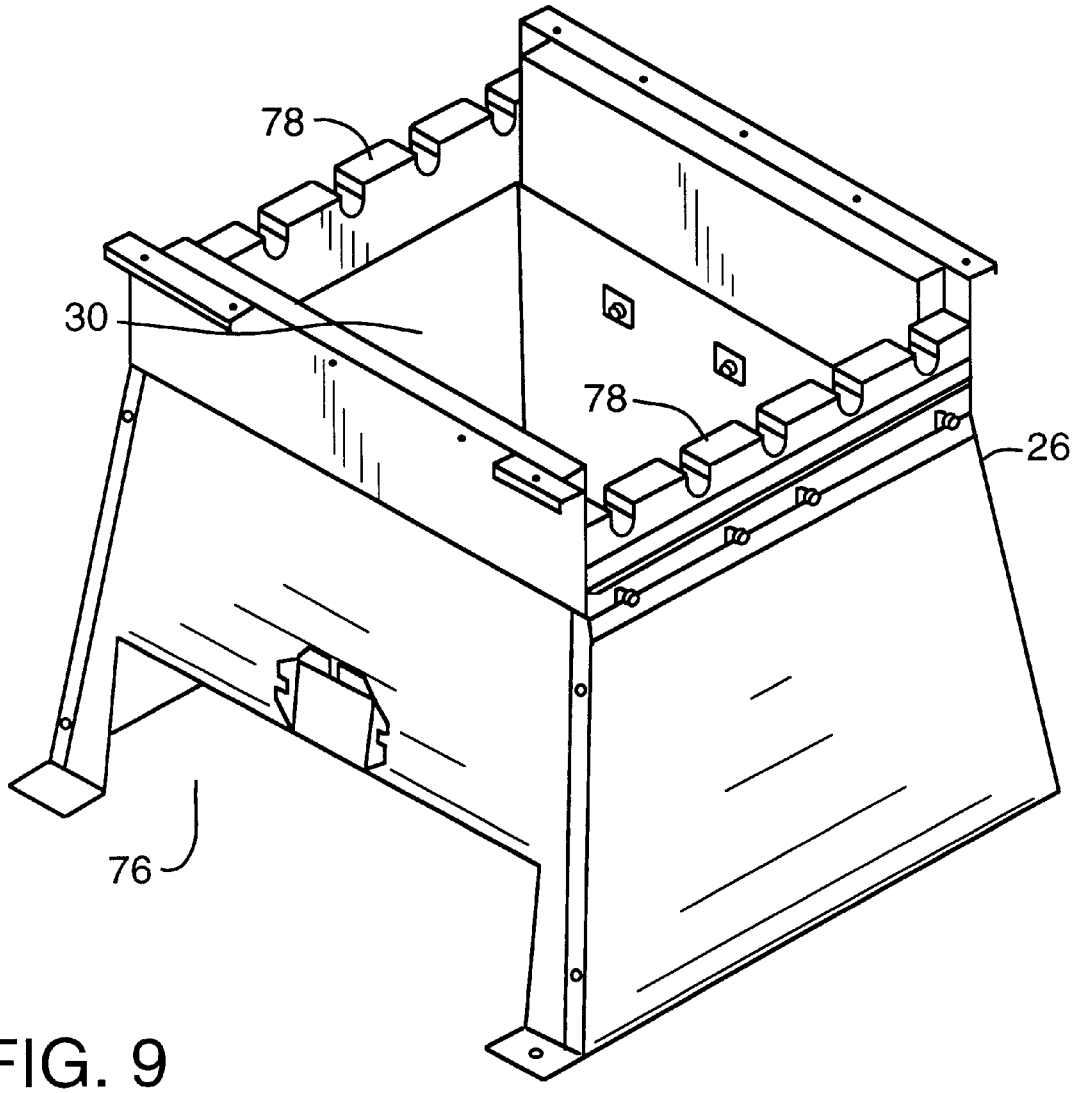
FIG. 9 is a perspective view of the housing of the heating appliance of FIG. 1.

FIG. 1 is a perspective view of a direct fired heating appliance 20 constructed according to the present invention. The appliance 20 may include a burner assembly 22 and a heat exchanger assembly 24 disposed within a housing 26, and a fan 28 for drawing air through the housing 26. In operation, fuel is burned at the burner assembly 22, thereby heating air present in the combustion chamber 30 which is illustrated in FIG. 9. The heated air contacts the heat exchanger assembly 24, transferring heat from the combustion air, through the heat exchanger assembly 24, to a lower temperature target medium flowing through the heat exchanger assembly 24.

Figure 2:
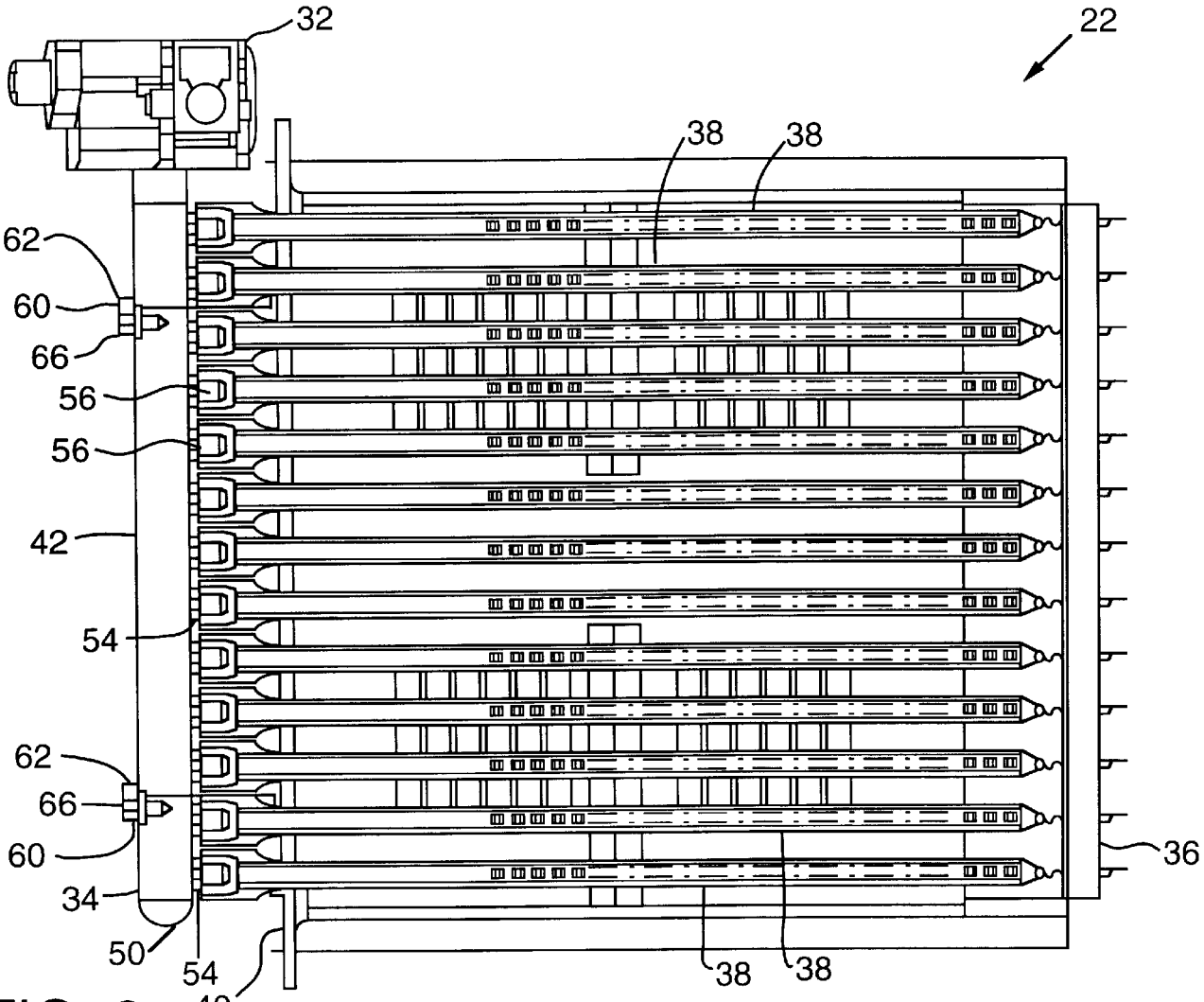
FIG. 2 is a top view of the burner assembly of the heating appliance of FIG. 1.
Figure 3:
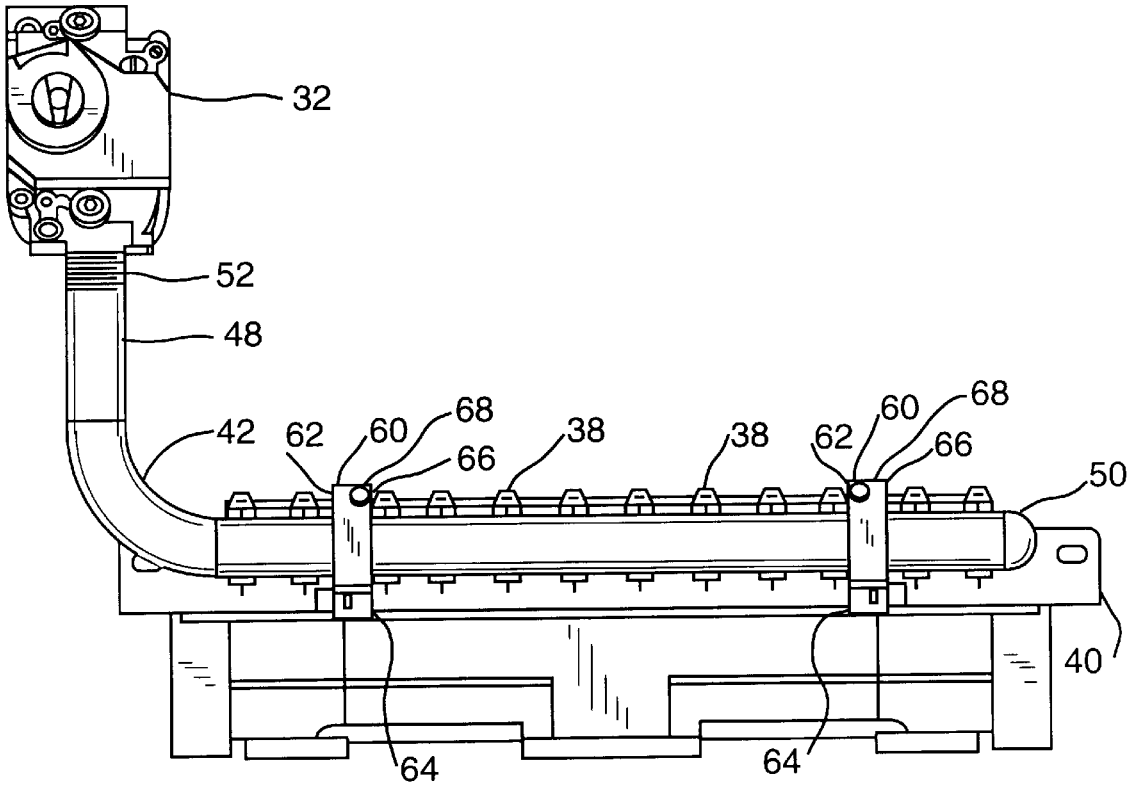
FIG. 3 is a left side view of the burner assembly of FIG. 2.
Figure 4:
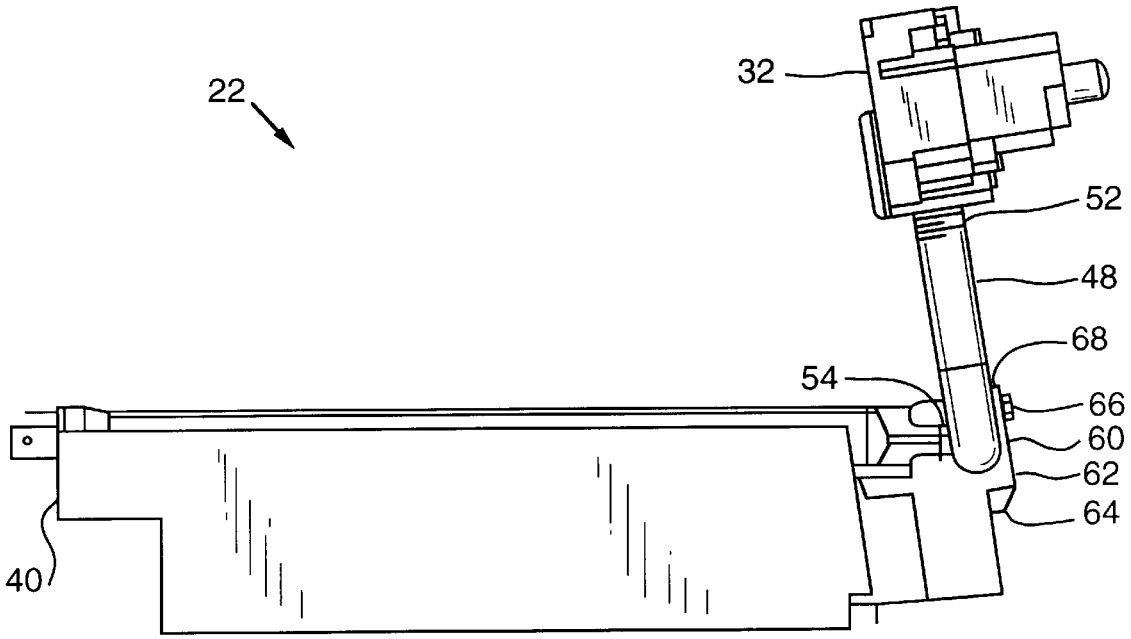
FIG. 4 is a rear view of the burner assembly of FIGS. 2 and 3.

FIGS. 2 through 4 illustrate a burner assembly 22 constructed in accordance with the present invention. The burner assembly 22 illustrated includes a combination gas valve and regulator 32, a fuel manifold 34, and a burner subassembly 36. The burner subassembly 36 is further comprised of burner elements 38 which are disposed in a burner rack 40.

Figure 8:
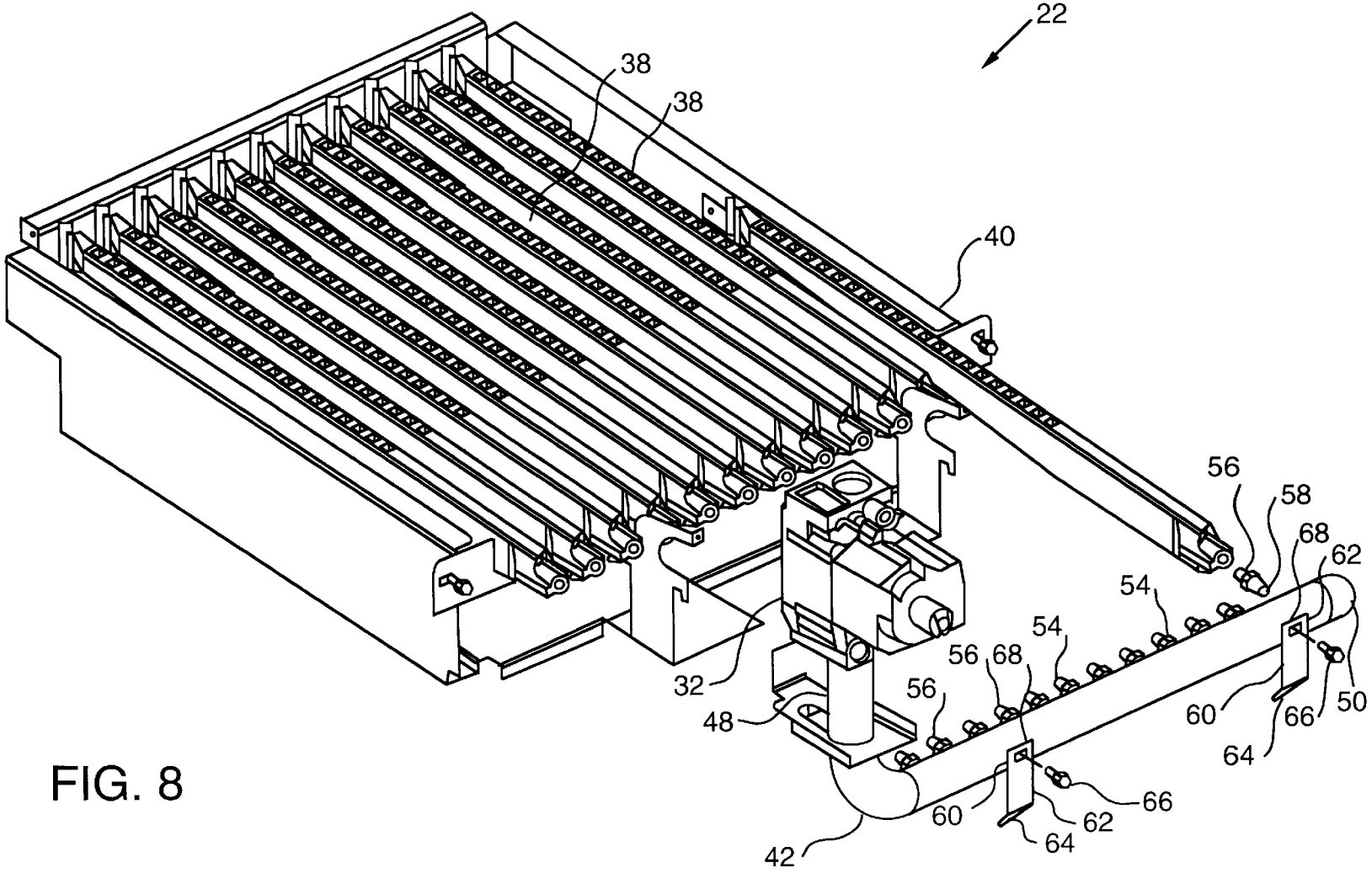
FIG. 8 is a partially exploded assembly view of the burner assembly of FIG. 2.
Figure 10:
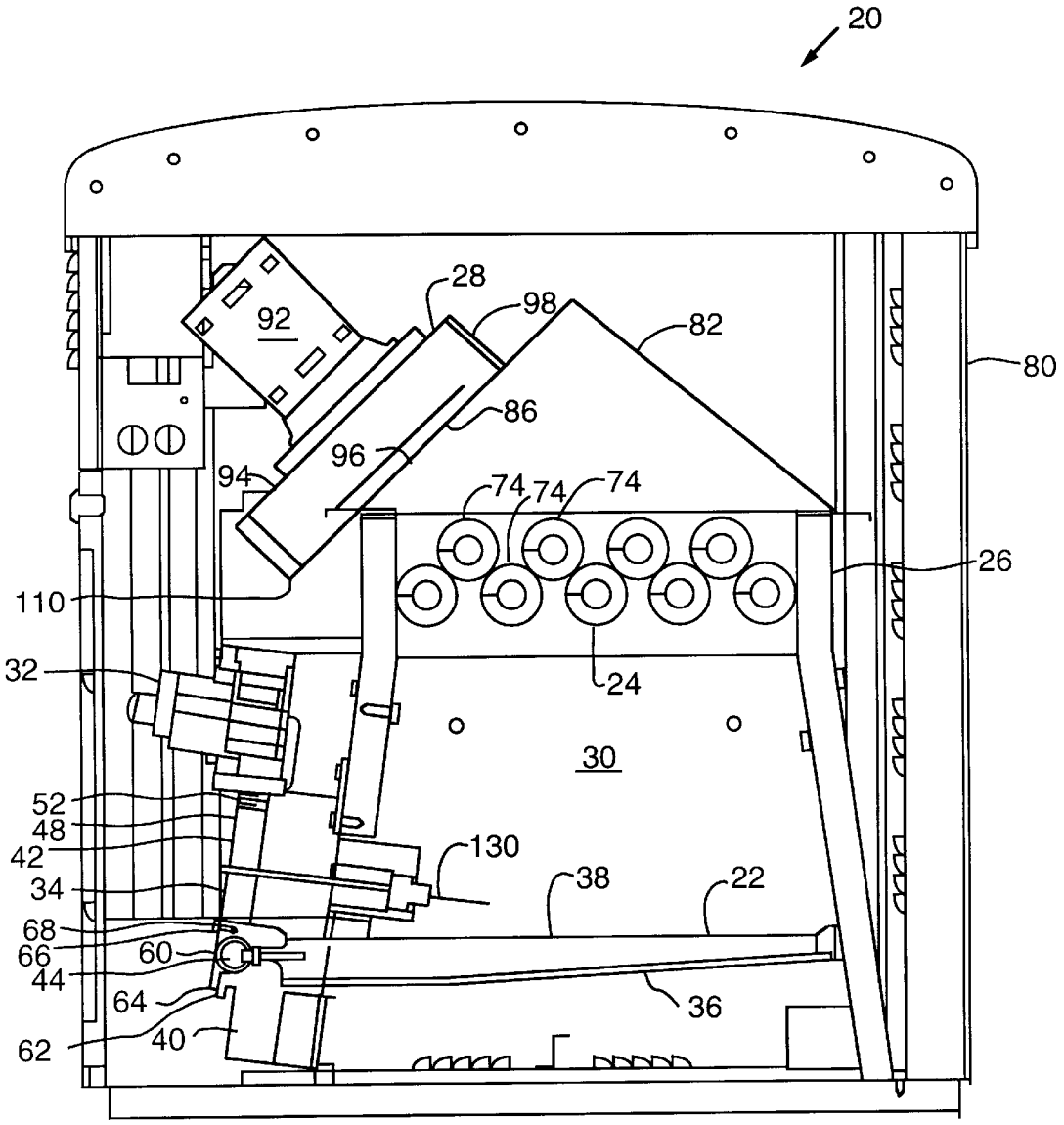
FIG. 10 is a cross-sectional view of a heating appliance of the present invention with a cover.

The fuel manifold 34 is comprised of a body 42 having an interior cavity 44 that is illustrated in FIG. 10. The body 42 may be a tube having an inlet end 48 and a closed end 50. As may be seen by reference to FIGS. 3 and 4, the inlet end 48 may have a connector 52 such as, for example, a threaded exterior surface, for connection to a fuel supply line or an intermediate device such as a combination gas valve and regulator 32. A plurality of coupling members 54 may be provided for complimentary engagement with the burner subassembly 36. As shown in FIG. 8, each coupling member 54 may include an insertion portion 56 that is slidingly received in a complementary opening in the burner subassembly 36. In addition, as also shown in FIG. 8, each coupling member 54 may include an orifice 58 that is in fluid communication with the interior cavity 44 of the body 42, such that fuel that is provided to the fuel manifold 34 may flow into the burner subassembly 36 through the orifices 58 of the coupling members 54.

Figure 5:
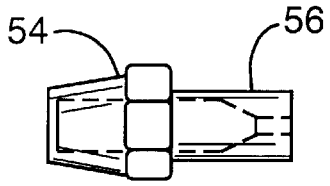
FIG. 5 is a side view of the coupling member of the burner assembly of FIG. 2.
Figure 6:
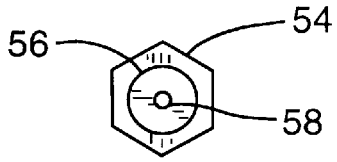
FIG. 6 is an end view of the coupling member of FIG. 5.

FIGS. 5 and 6 illustrate a coupling member 54 having a cylindrical insertion portion 56 with the same exterior radius throughout its length. The coupling member 54 and the attached fuel manifold 34 may be readily engaged with and disengaged from the burner subassembly 36 because the exterior surface of the insertion portion 56 has a uniform radius and no barb so that the insertion portion 56 does not become permanently fastened to the burner subassembly 36. Such a disengageable fuel manifold 34 is advantageous because it may be replaced if, for example, the manifold 34 is damaged or a manifold having a different configuration is desired.

Figure 7:
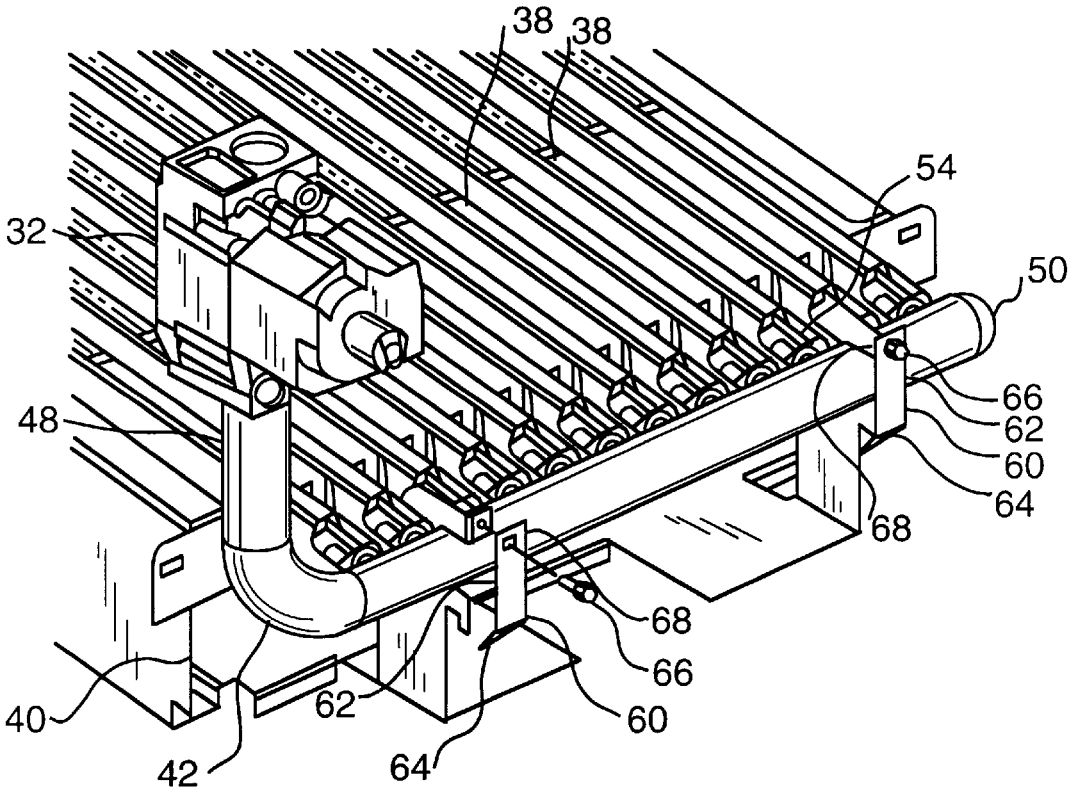
FIG. 7 is a partial perspective view of the burner assembly of FIG. 2 in which an exploded assembly view of one of the hasps of FIG. 2 is illustrated.

FIG. 7 illustrates a partial view of a burner assembly 22 that includes attachment devices which may be, for example, hasps 60 for retaining the fuel manifold 34 in cooperation with the burner subassembly 36. FIG. 8 shows a partially exploded assembly view of a burner assembly 22 that illustrates one of the burner elements 38 being installed in the burner rack 40, a coupling member 54 positioned to engage the fuel manifold body 42 and cooperate with the burner subassembly 36, a fuel manifold 34 positioned to be accepted by additional burner elements 38 and the burner rack 40, and hasps 60 with screw fasteners 66 for retention of the fuel manifold 34 in cooperation with the burner elements 38 and burner rack 40. One or more hasps 60 may be used to retain a fuel manifold 34. The number of hasps 60 will vary depending on the size and configuration of the fuel manifold 34. Each hasp 60 includes a retaining member 62 and may include a fastener 66. The retaining member 62 may engage the heater 20 at a first end 64 by, for example, hingedly or slidably engaging the burner assembly 22 or housing 26. A fastener 66 may be utilized to removably attach a second end 68 of the retaining member 62 to the heating appliance 20. The fastener 66 may be, for example, a screw that is placed through a hole or slot in the retaining member 62 and threaded into a portion of the housing 26 as is illustrated in FIG. 7. In another embodiment, which is not illustrated in the Figures, a wingnut may be threaded on a stud that extends from the housing 26 through the retaining member 62. Use of the removable hasp 60 advantageously facilitates removal and replacement of the fuel manifold 34.

Referring again to FIG. 1, the heat exchanger assembly 24 may be any apparatus that can permit heat to be transferred from the burner assembly 22 to a target medium, such as, for example, pool or spa water. The heat exchanger assembly 24 illustrated includes a target medium inlet port 70, a target medium outlet port 72 and a plurality of heat exchanger tubes 74 which are illustrated in FIG. 10. Many target media may pass through the heat exchanger assembly 24 including, for example, gasses such as air or steam, or fluids such as water or glycol. In a pool heater application, for example, pool water is propelled through the heat exchanger tubes 74 by a conventional means such as, for example, a pump. Heated combustion air, meanwhile, passes across the outer surfaces of the heat exchanger tubes 74 to heat the heat exchanger tubes 74 and the pool water flowing through the tubes 74.

The heat exchanger may also be provided with baffles, which are not shown in the Figures. Such baffles may be employed to direct air around and in contact with heat exchanger tubes 74 to promote heat transfer from the combustion air to the target medium.

FIG. 9 illustrates a housing 26 suitable for use in the present invention. The housing 26 may have a combustion air inlet 76 in which the burner assembly 22 may be disposed, heat exchanger support surfaces 78 on which the heat exchanger assembly 24 may be disposed and a combustion chamber 30 intermediate the burner assembly 22 and heat exchanger assembly 26.

Figure 12:
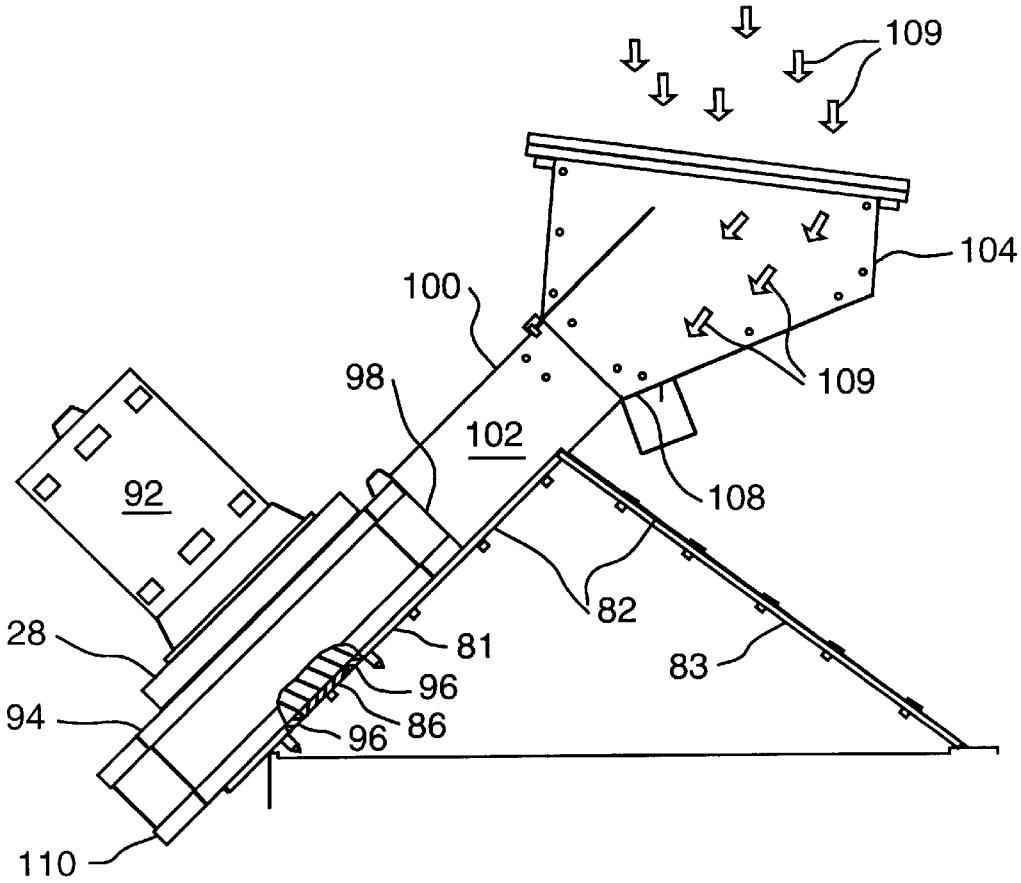
FIG. 12 is an enlarged view of the top of the housing and fan of the heating appliance of FIGS. 1 and 11.

FIG. 10 is a cross-sectional side view of a heater 20 constructed in accordance with the present invention. A cover 80 may be provided over the heating appliance 20 or a portion thereof, to protect the appliance 20 from harmful conditions or influences such as precipitation, chemicals or foreign objects. The housing 26 may have an angled top 82 with the venting fan 28 mounted on the angled top 82. The angled top 82 is formed from a first upwardly sloping wall portion 81 and an intersecting second upwardly sloping wall portion 83 as shown in FIG. 12. A flue 86 is affixed to the first wall portion 81 and the cover 80 may include a combustion air exhaust opening 88.

The venting fan 28 may be utilized to draw air into the combustion chamber 30 of the housing 26 through the combustion air inlet 76. Air entering the combustion chamber 30 provides oxygen for the combustion of the fuel, and is commonly referred to as "combustion air." Air entering the combustion chamber 30 is also heated by the burning fuel. Heated air from the combustion chamber 30 is then drawn through the heat exchanger 24, where heat is transferred from the high temperature air, through the heat exchanger 24, and into the target medium. The combustion air is next drawn into the flue 86, where it is commonly referred to as "flue gas." Air in the flue 86 is then vented out of the housing 26 by the fan 28 and out an opening 88 in the cover 80.

Figure 11:
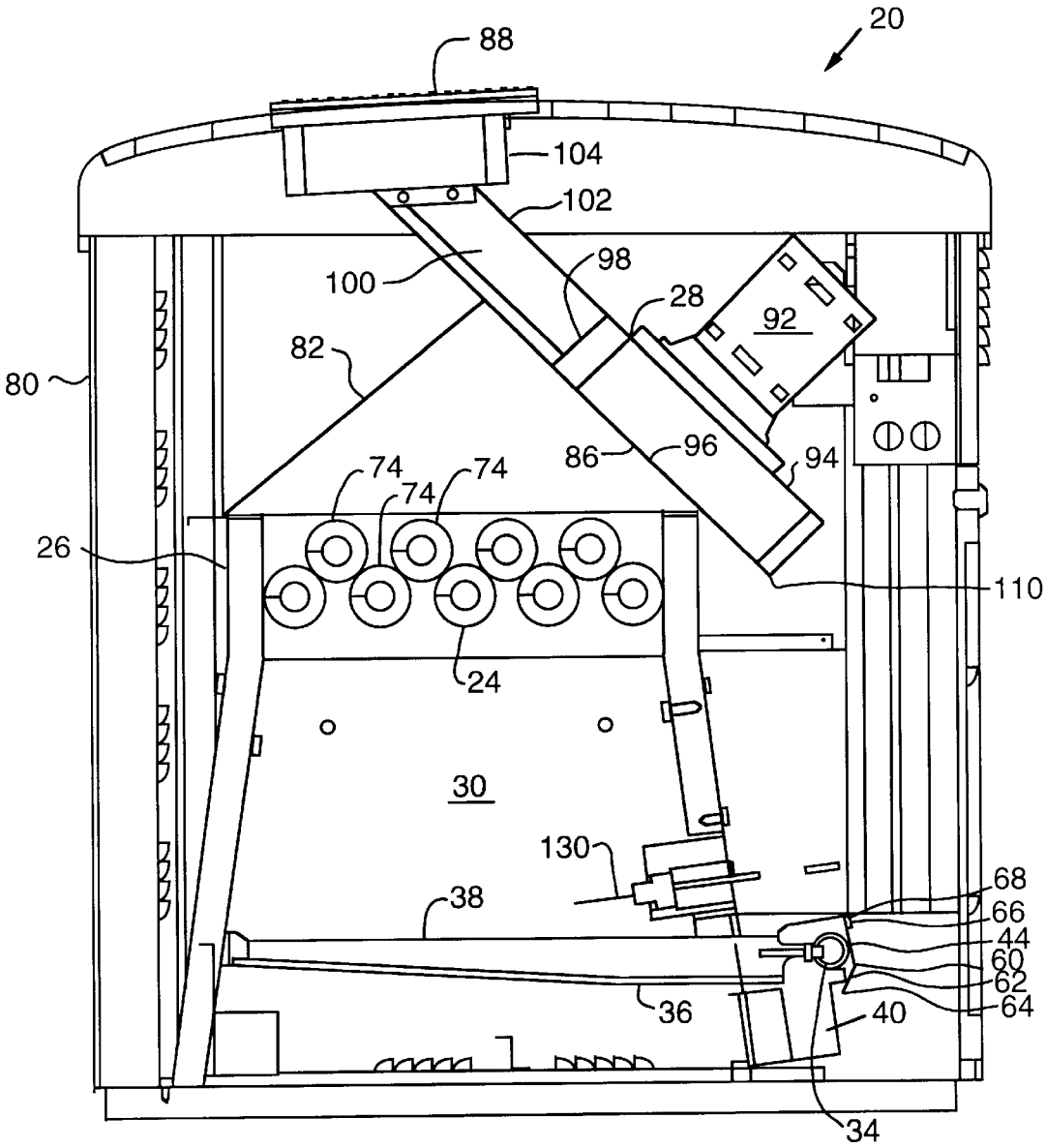
FIG. 11 is a cross-sectional view of the heating appliance of FIG. 1 with a cover, taken along line XI—XI in FIG. 1.

FIG. 11 is a cross-sectional view of a heater 20 depicting the exhaust opening 88 of the cover 80. The fan 28 includes a blower which is not shown in the Figures, a fan motor 92 and a fan housing 94 having an intake opening 96 and a discharge opening 98. The fan 28 may be mounted such that the fan intake 96 is in communication with the flue 86 of the angled top 82 of the housing 26. When a cover 80 is utilized, the fan discharge opening 98 may be disposed such that air expelled by the fan 28 is directed parallel to the first wall portion 81 of the angled top 82 of the heating appliance housing 26 and toward the cover exhaust opening 88 to minimize the amount of discharge air that becomes trapped within the cover 80. The cover exhaust opening 88 may be horizontally offset from the fan 28 and, at the same time, aligned with the discharge airstream because the angularly disposed fan 28 may direct the airflow across the housing 26 to a point in the cover 80 horizontally offset from the fan 28. The result of such a configuration is that precipitation or foreign objects that enter the cover 80 through its exhaust opening 88 will not fall into direct contact with the fan 28. The advantages of mounting the fan 28 at an angle, therefore, include providing an unrestrictive discharge for the fan 28 and the protection of the fan 28 from harmful conditions or influences.

Airflow may be conducted from the fan discharge 98 to the cover exhaust opening 88 by configuring the heating appliance 20 in a variety of arrangements. FIG. 11 illustrates one configuration in which a direct pathway is provided between the fan 28 and cover 80 to prevent flue gasses from contacting heater components. It is desirable to prevent flue gasses from contacting heater components because flue gasses contain materials that are corrosive to heater components. The pathway may be a duct 100 that is coaxially affixed such that the air is directed parallel to the first upwardly sloping wall 81 to the discharge of the fan 28. The enclosed duct 100 contains the exhaust air until the air exits the cover 80, thereby preventing the corrosive flue gasses from contacting heater components and also preventing the flue gasses from mixing with intake air that may flow freely within the cover 80. A parallel duct 100 that is coaxial with the discharge opening of the fan is advantageous because it reduces the restrictive, pressure dropping characteristics of bends in ductwork. The duct 100 may comprise a sleeve 102 that extends to a plenum 104 that engages the cover 80.

Figure 15:
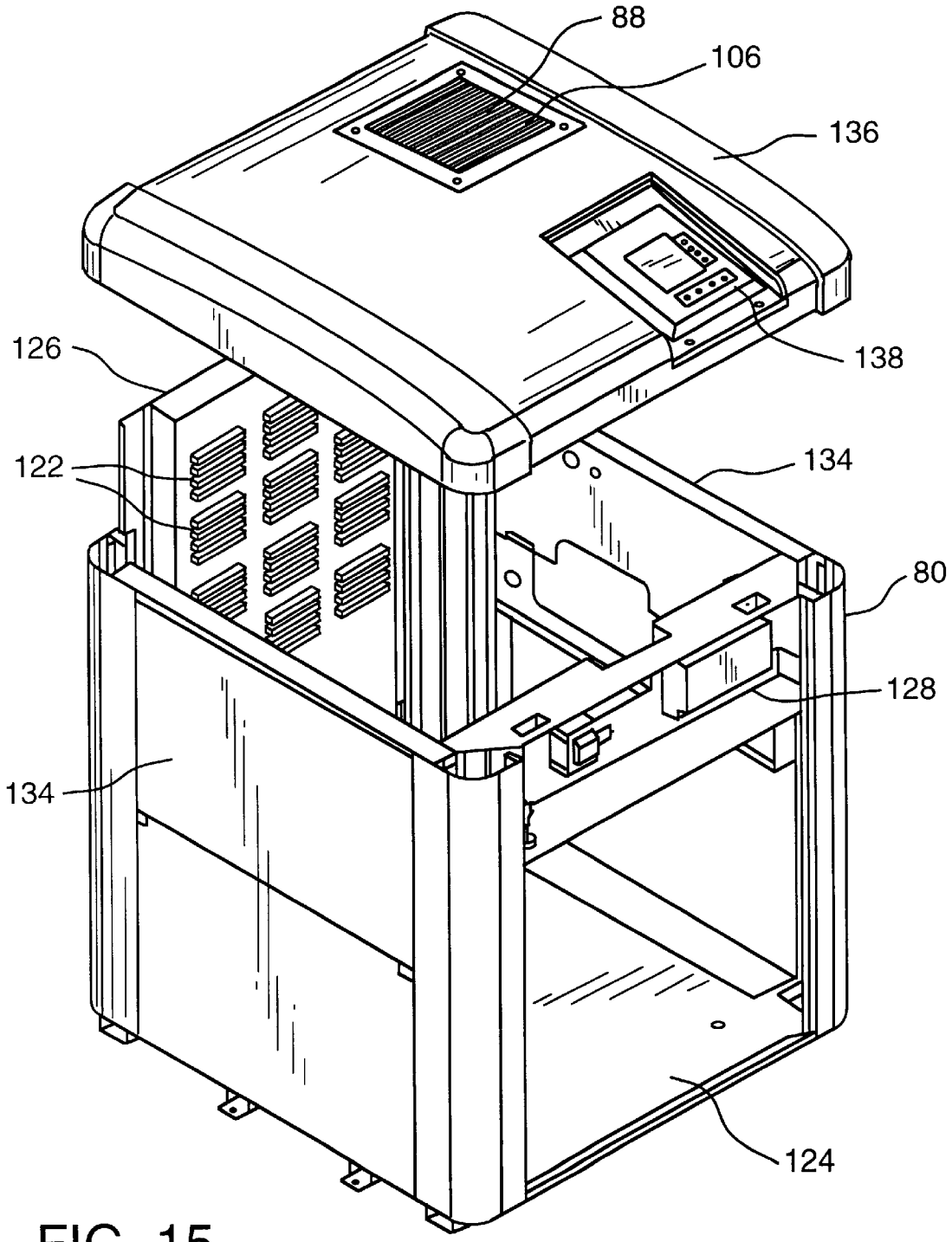
FIG. 15 is a partially exploded assembly view of the cover of FIG. 14 with the front panel removed.

The exhaust opening 88 may alternately be provided with louvers 106, as illustrated in FIG. 15. The louvers 106 may extend toward the fan discharge 98 and may be oriented parallel to the flue gas stream discharged by the fan 28. Such louvers 106 may direct the air stream toward the exhaust opening 88, thereby preventing the flue gasses from becoming trapped within the cover 80.

FIG. 12 illustrates a venting fan 28 with a duct 100 that includes an upper drain 108 through which elements 109 entering the cover exhaust opening 88 may be removed and thus prevented from reaching the fan 28. A lower drain, which is similar to the upper drain 108 but which is not illustrated in the Figures, also may be provided at, for example, a low point 110 in the fan housing 94 to remove any elements 109 that collect in the fan housing 94. Those elements 109 may include water and other materials that may condense in or otherwise enter the fan housing 94 or duct 102. Elements 109 that enter the fan housing 94 will collect at the lower edge 110 of the fan housing 94 because of the fans angled disposition. Therefore, a lower drain provided in the lower edge 110 of the fan housing 94 may permit the elements to pass out of the fan 28. By eliminating the presence of harmful elements 109 in the fan 28, the life of the fan 28 may be extended.

Another concern in the heater arts is the control of heat within the heating appliance 20. For example, it is beneficial to maintain low temperatures at heat sensitive components because high temperatures are known to cause early failure in those components. A "heat sensitive component," as that term is used herein, is a component that has a reduced service life if subjected to temperatures at which the heating appliance operates relative to the component's service life if subjected to room temperatures. Additionally, heat that transfers through the housing 26 of the heating appliance 20 rather than transferring into the target medium through the heat exchanger 24 creates a reduction in heater efficiency.

Figure 13:
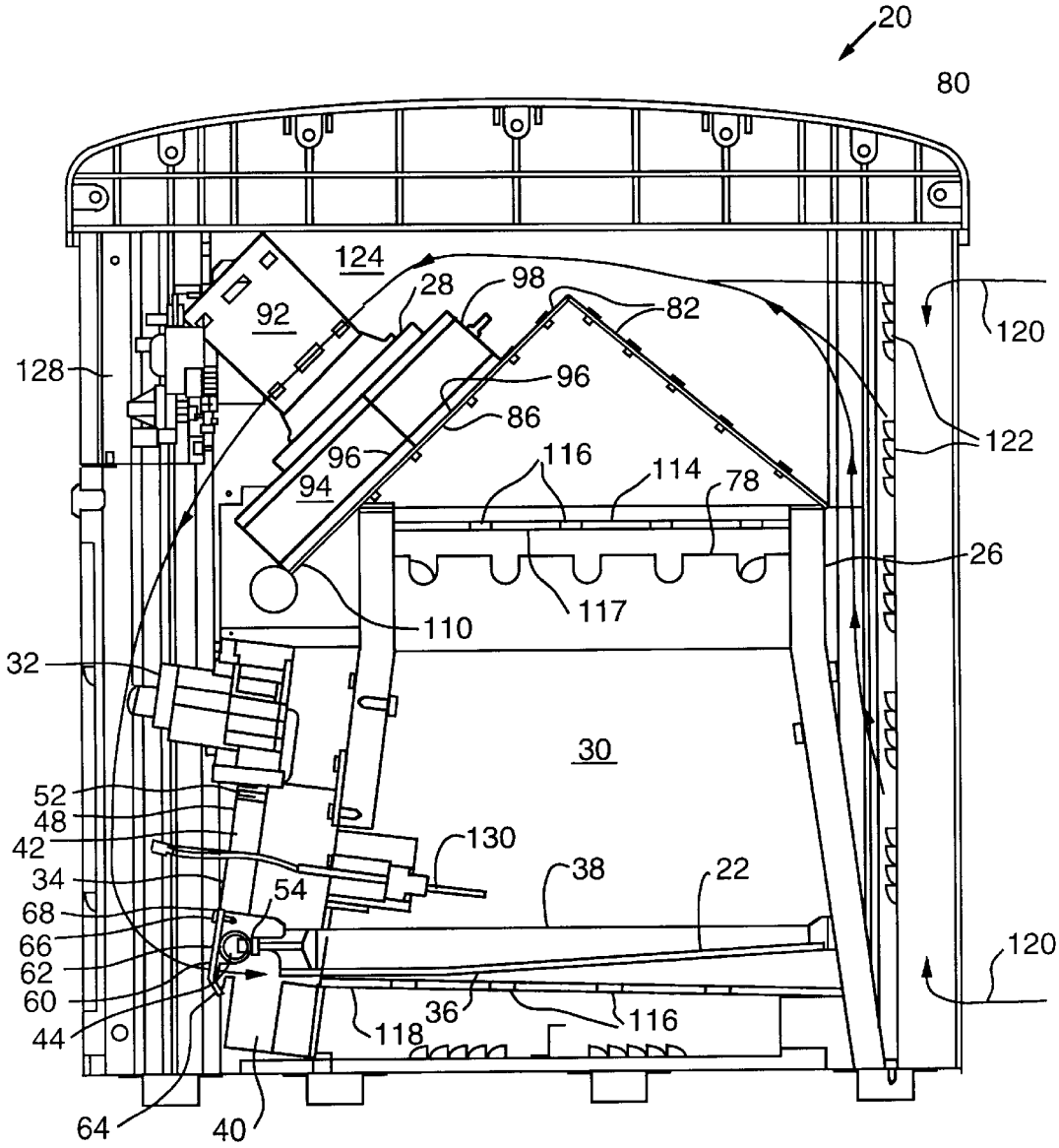
FIG. 13 is a cross-sectional view of a heating appliance of the present invention depicting a combustion air intake airflow pattern.

FIG. 13 illustrates a cross-sectional view of a heating appliance 20 constructed in accordance with the present invention which also indicates an intake airflow pattern 120. The present invention may utilize a baffle 114 in the flue 86 to reduce the turbulent affect that the fan 28 has on air flowing through the heating appliance 20. In the illustrated embodiment, a first perforated plate form of baffle 114 is disposed across the flue 86 above the heat exchanger 24. The first perforated plate 114 may be disposed horizontally extending to each side wall of the flue 86, so that communication between the combustion chamber 30 and fan 28 may only occur through the first perforated plate 114. The perforations 116 extend through the first perforated plate 114 and may be located symmetrically throughout the plate 114. The first perforated plate 114 restricts the air flowing through it, thereby creating an air pressure drop. Air flowing through the first perforated plate 114 is also laminarized by passing through the perforations 116 of the plate 114. The pressure drop and laminarization effects of the first perforated plate 114 combine to reduce turbulence on the combustion chamber side 117 of the plate 114.

As air is drawn out of the flue 86 by the fan 28, fresh combustion air is drawn into the combustion chamber 30 through the combustion air inlet 76 of the housing 26. The pressure at which air is drawn into the combustion air inlet 76 may also be sufficient to cause turbulence in the combustion chamber 30. Therefore, a second perforated plate 118 may also be utilized intermediate the inlet 76 and the burner assembly 22 to reduce the turbulence of the air entering the combustion chamber 30.

FIG. 13 also illustrates a combustion air intake flow pattern 120 that may be utilized in the heater 20 to cool heat sensitive components and preheat the combustion air. The combustion air may be drawn into the cover 80 through one or more intake openings 122 which may, for example, be finned sections, through an interior chamber 124 of the cover 80 and into the combustion air inlet 76. The combustion air inlet 76 may be located in the lower part of the front of the heater housing 26 and the combustion air intake opening 122 may be located in the rear panel 126 of the cover 80. When the heating appliance 20 is arranged in such a configuration, combustion air may be drawn into the heater 20 through the combustion air intake opening 122 of the cover 80 and forced to flow around the housing 26 prior to entering the combustion air inlet 76. The intake airflow pattern 120 may also direct the combustion airstream past components that benefit from operating at a lower temperature, such as, for example, fans, electronic components, combustion components, and raceways and enclosures containing such components.

The temperature of the fan motor 92 may also be reduced by restricting the fan intake opening 96. A restricted intake opening 96 reduces the amount of airflow entering the fan 28, thereby reducing the load on the fan motor 92. Less electricity is required by the fan motor 92 when moving a reduced amount of air through the fan 28 and, therefore, less heat-producing electrical current flows through the fan motor 92, thereby creating less heat in the fan motor 92. High temperatures are known to have a deleterious effect on fan motors 92. The restricted inlet 96, therefore, increases the life of the fan motor 92 by reducing the operating temperature of the fan motor 92.

In operation, utilizing the airflow pattern of FIG. 13, air from outside the heating appliance 20 may be brought into the interior chamber 124 of the cover 80 through the intake openings 122 of the rear panel 126 of the cover 80. The air may be forced to flow around the housing 26, thereby coming into contact with surfaces of the housing 26 and drawing heat from the housing 26 that would otherwise be lost by radiation and conduction. A substantial portion of the airstream may also be directed across the top 82 of the housing 26 and past the fan 28, drawing away heat created by both the heating appliance 20 itself and the fan motor 92. Portions of the intake airstream may, likewise, be directed across an electronic component raceway 128 and combustion components including the combination gas valve and regulator 32 and an igniter 130, thereby drawing harmful heat away from the heat sensitive components. The heated air may then flow into the combustion air inlet 76 where the preheated air is used in the combustion and heat transfer process. Preheated air promotes combustion and also beneficially raises the temperature of the air passing through the heat exchanger.

Figure 14:
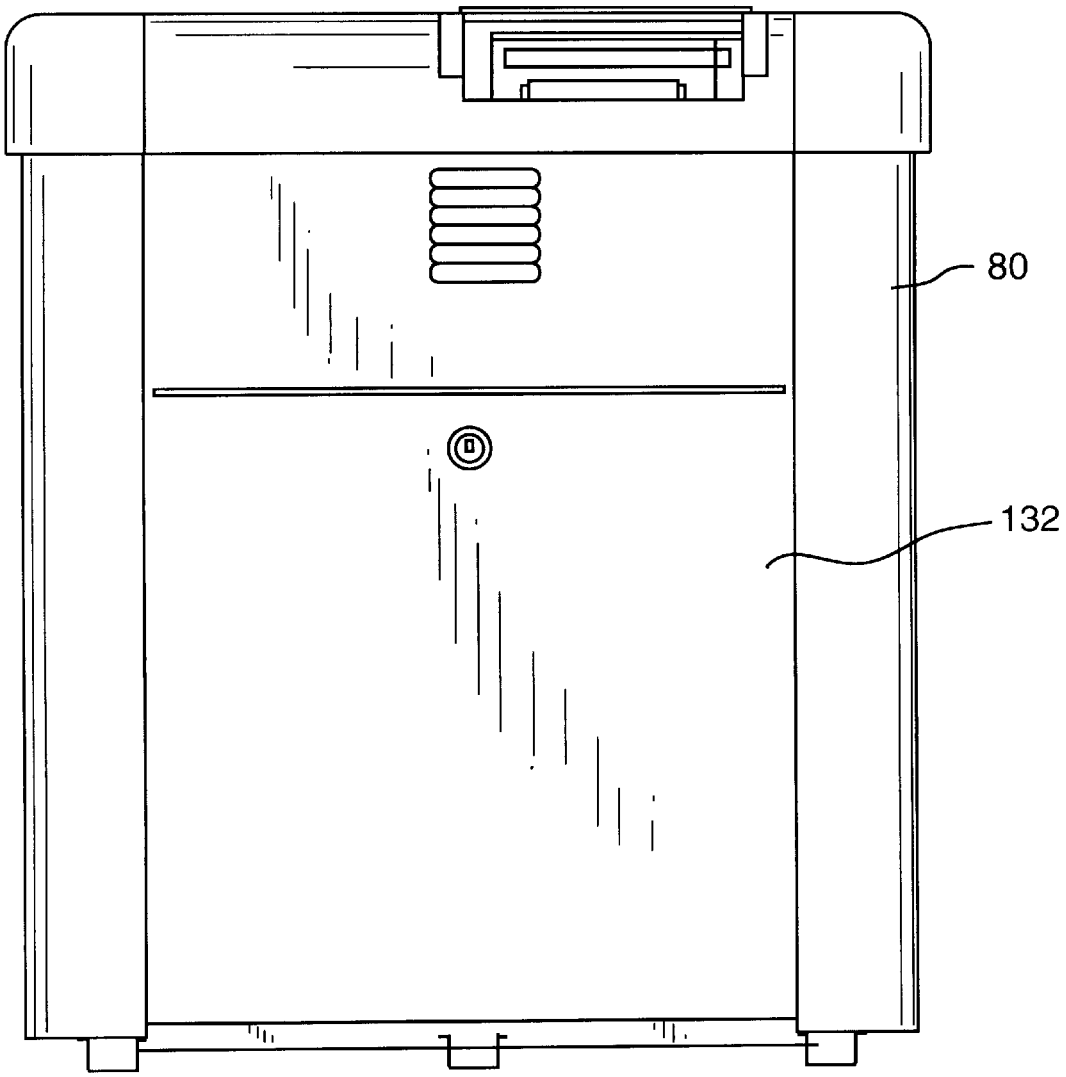
FIG. 14 is a front elevational view of a heating appliance cover of the present invention.

A cover 80 suitable for use with the present invention is further illustrated in FIGS. 14 and 15. FIG. 14 illustrates a front view of the cover 80, including a front panel 132. FIG. 15 illustrates a partially exploded assembly view of the cover 80 of FIG. 14 with the front cover 132 removed.

Depicted in FIG. 15 are side panels 134, the rear panel 126 with finned intake openings 122, a lid 136 having the exhaust opening 88, a control panel 138, and the electrical component raceway 128.

What is claimed is:

1. A heater comprising:

a heating device including a housing having an angled top, said angled top having an upwardly sloping portion and a flue; and a fan having an intake opening through said upwardly sloping portion and in communication with said flue, said fan having a discharge opening disposed perpendicular to said upwardly sloping portion of said angled top of said housing to upwardly discharge air therethrough.

2. The heater of claim 1, further comprising a restriction in said fan intake opening.

3. The heater of claim 1, wherein said heating device further comprises:

a burner supported by said housing; and a heat exchanger supported by said housing intermediate said burner and said flue.

4. The heater of claim 3, further comprising an inlet and a baffle, said baffle disposed in said housing intermediate said inlet and said burner.

5. The heater of claim 4, wherein said baffle is an airflow laminarizing baffle.

6. The heater of claim 5, wherein said baffle includes a plate having a plurality of perforations therethrough.

7. The heater of claim 3, further comprising an outlet and a baffle, said baffle disposed in said housing intermediate said heat exchanger and said outlet.

8. The heater of claim 7, wherein said baffle is an airflow laminarizing baffle.

9. The heater of claim 8, wherein said baffle includes a plate having a plurality of perforations.

10. A heater comprising:

a heating device including a housing having an angled top, said angled top having a flue;

a fan having an intake opening and a discharge opening, said intake opening in communication with said flue and said discharge opening disposed perpendicular to said angled top of said housing; and a drain in said fan.

11. The heater of claim 10, wherein said fan has an upper portion and a lower portion and said drain is in said lower portion of said fan.

12. The heater of claim 10, wherein said fan has an upper portion and a lower portion and said drain is in said upper portion of said fan.

13. The heater of claim 10, wherein said fan has an upper portion and a lower portion and said upper portion of said fan further comprises a duct for directing combustion airflow.

14. The heater of claim 7, further comprising a cover, wherein said duct extends to said cover.

15. A heater comprising:

a heating device including a housing having an angled top, said angled top having a flue;

a fan having an intake opening and a discharge opening, said intake opening in communication with said flue and said discharge opening disposed perpendicular to said angled top of said housing; and a cover disposed over said fan, said cover having louvers directed toward said discharge opening of said fan.

16. A heater comprising:

a heating device including a housing having an angled top, said angled top having a flue; and a fan having an intake opening and a discharge opening, said intake opening in communication with said flue and said discharge opening disposed parallel to said angled top of said housing, and wherein said fan intake includes an adjustable restriction.

17. A heater comprising:

a housing having an inlet and an outlet;

a burner supported by said housing;

a heat exchanger supported by said housing intermediate said burner and said outlet of said housing;

a fan in communication with said housing; and an airflow laminarizing baffle disposed in said housing intermediate said inlet and said burner.

18. The heater of claim 17, wherein said airflow laminarizing baffle includes a perforated plate.

19. The heater of claim 18, wherein said airflow laminarizing baffle includes a plate having a plurality of perforations therethrough.

20. The heater of claim 17, further comprising a second airflow laminarizing baffle disposed in said housing between said heat exchanger and said fan.

21. The heater of claim 20, wherein said second baffle includes a perforated plate.

22. A heater, comprising:

a housing having an inlet and an outlet;

a burner supported by said housing;

a heat exchanger supported by said housing intermediate said burner and said outlet of said housing;

a fan in communication with said housing; and an airflow laminarizing baffle disposed in said housing intermediate said heat exchanger and said outlet.

23. The heater of claim 22, wherein said airflow laminarizing baffle includes a perforated plate.

24. The heater of claim 23, wherein said airflow laminarizing baffle includes a plate having a plurality of perforations therethrough.

25. A direct fired heater, comprising:

a housing;

a burner supported by said housing;

a manifold engagable with said burner;

a hasp hingedly fastened to the housing at a first end and having a retaining member disposed at least partially around the manifold for holding said manifold in operable engagement with said burner; and a heat exchanger supported by said housing such that heat from said burner will be incident on said heat exchanger.

26. An direct fired heater, comprising:

a housing having a combustion air inlet and a sloping upper surface, said sloping upper surface having a flue;

a burner supported by said housing in communication with said housing inlet;

a heat exchanger supported by said housing such that heat from said burner will be incident on said heat exchanger;

a fan having a fan housing, said fan housing having an intake area, a discharge area, and a drain, said intake area in communication with said flue and said discharge area disposed parallel to said upper surface of said fan housing, said drain disposed such that elements entering said fan will be gravitationally discharged therefrom through said drain, said fan inducing airflow from said inlet past said burner and in contact with said heat exchanger;

a cover disposed over said heater, said cover having an exhaust opening horizontally offset from said fan and at which said discharge area is directed.

27. A method of propelling combustion air through a heater including a fan, said method comprising:

providing the heater with an upwardly sloping portion and an outlet in the upwardly sloping portion;

drawing the combustion air through the outlet of the upwardly sloping portion; and directing the combustion air upward and parallel to the upwardly sloping portion of the heater.

28. The method of claim 27, wherein said act of directing includes directing the combustion air through a cover.

29. The method of claim 27, wherein the act of drawing includes drawing the combustion air through the fan having an inlet, the inlet including a restriction.

30. A method of propelling combustion air through a heater including a fan, said method comprising:

providing the heater with a sloping upper surface and an outlet in the upper surface;

drawing the combustion air through the opening of the upper surface;

directing the combustion air parallel to the upper surface of the heater; and draining liquid that enters the heater away from the fan before the liquid enters the fan.

31. A method of propelling combustion air through a heater including a fan, said method comprising:

providing the heater with a sloping upper surface and an outlet in the upper surface;

drawing the combustion air through the opening of the upper surface;

directing the combustion air parallel to the upper surface of the heater; and draining liquid that enters the fan out of the fan.

32. A method of laminarizing combustion airflow in a heater, the method comprising directing the combustion air through at least one baffle oriented parallel to a burner and a heat exchanger to laminarize airflow flowing through the burner and the heat exchanger.

33. The method of claim 32, wherein the at least one baffle is a perforated plate.

34. The method of claim 32, wherein in the act of directing the combustion air is directed through two baffles.

35. A heater comprising:

a housing having an inlet and an outlet;

a burner supported by said housing;

a heat exchanger supported by said housing intermediate said burner and said outlet of said housing;

a fan in communication with said housing; and a baffle having a plurality of perforations therein and disposed in said housing intermediate said inlet and said outlet.

* * * * *